US008047892B1

(12) United States Patent
Dempsey

(10) Patent No.: US 8,047,892 B1
(45) Date of Patent: Nov. 1, 2011

(54) WOMAN'S UNDERGARMENT TO REMEDY CHEST WRINKLES

(76) Inventor: Darlene S. Dempsey, Fair Oaks, CA (US)

( * ) Notice: Subject to any disclaimer, the term of this patent is extended or adjusted under 35 U.S.C. 154(b) by 198 days.

(21) Appl. No.: 12/387,405

(22) Filed: May 1, 2009

(51) Int. Cl.
*A41C 3/00* (2006.01)

(52) U.S. Cl. ..... 450/54; 450/57

(58) Field of Classification Search ..... 450/54–58, 450/36–38, 86, 88, 89, 39; 2/267, 268, 463; 602/19
See application file for complete search history.

(56) References Cited

U.S. PATENT DOCUMENTS 5,158,541 A * 10/1992 McCurley ..... 602/79
5,807,160 A * 9/1998 Wehmeyer ..... 450/57
6,095,894 A * 8/2000 Stevens ..... 450/57
6,102,772 A * 8/2000 Fernandez ..... 450/1
6,769,955 B1 * 8/2004 Fisher ..... 450/54
7,001,239 B2 * 2/2006 Russell ..... 450/57
7,144,295 B2 * 12/2006 Fisher ..... 450/54
7,445,541 B2 * 11/2008 Patterson ..... 450/54

OTHER PUBLICATIONS

Windsor Direct; Chest-A-Peel Heart Series Pillow-Pad; www.windsordirect.net.

* cited by examiner

*Primary Examiner* — Gloria Hale
(74) *Attorney, Agent, or Firm* — Heisler & Associates

(57) ABSTRACT

An undergarment for wearing about the torso of a woman. The undergarment includes a central spacer of elongate form which is sized to reside between the breasts and keep them spaced from each other, particularly when the woman is lying down. A lower band girds the torso of the woman and supports a lower end of the central spacer. Shoulder straps extend from the upper end of the central spacer which are of adjustable length to help keep the central spacer firmly in position against the skin of the woman between the breasts. A central pad can also be provided, such as by being removably attachable, over a cleavage area between and above the breasts to press directly against the skin to prevent wrinkle formation and to eliminate wrinkles from the chest of the woman.

20 Claims, 8 Drawing Sheets

WOMAN'S UNDERGARMENT TO REMEDY CHEST WRINKLES

FIELD OF THE INVENTION

The following invention relates to undergarments, and particularly women's undergarments for wearing by a woman to manage breast position. More particularly, this invention relates to women's undergarments worn about the torso particularly when sleeping and to prevent and treat chest wrinkles which have a tendency to form vertically at and above a cleavage area between the breasts and extending towards the neck.

BACKGROUND OF THE INVENTION

Wrinkles are formed in skin when the skin is both folded against itself for extended periods of time and the skin has lost some of its original elasticity. Loss of such elasticity is often a natural effect of the aging process. With the loss of such skin elasticity, skin locations where the skin is sometimes folded, particularly for long periods of time, will develop a lined wrinkled appearance with the wrinkles being mostly linear and following troughs in the skin, where the skin has been folded against itself. Generally, the development of wrinkles is considered to be undesirable aesthetically as it can make one look older. Hence, efforts have been made in the prior art to resist wrinkle formation and to treat wrinkles once they occur.

Certain places on the body are more susceptible to the formation of wrinkles than others. Some of these locations are not typically covered by clothing and thus present the greatest negative influence on the person's appearance. One particular location where wrinkles have a propensity to form which can be particularly undesirable is in the cleavage area on the chest of a woman, between her breasts and extending up from her breasts toward her neck. Such chest wrinkles typically extend substantially vertically and can begin approximately at a midpoint between the breasts and extend up close to the neck. Many clothing tops, especially for woman, include a low neckline which exposes this cleavage area. When vertical chest wrinkles are in this cleavage area and a woman is wearing such a low neckline top, the vertical chest wrinkles are visible, tending to degrade the woman's appearance.

The inventor has discovered through careful study that such vertical chest wrinkles form largely while the woman is sleeping on her side. When a woman is standing, the skin in the cleavage area is not folded against itself, except perhaps in a lower portion of this cleavage area between and slightly above the breasts. The upper cleavage area and extending toward the neck is generally flat when the woman is standing. Similarly, when the woman is lying on her back, the breasts rest away from each other so that the skin does not fold against itself to present the possibility of development of wrinkles. However, when a woman is lying on her side the breasts tend to be drawn together and vertical chest wrinkles can form. In particular, when the woman is lying on her side, the lower breast is supported by a mattress or other underlying support. An upper breast is drawn by gravitational forces down against the lower breast. The skin between the breasts and in the cleavage area is folded against itself along a vertical trough extending up towards the neck of the woman. Over time, and with the loss of skin elasticity, this vertical skin fold can turn into one or more vertical chest wrinkles. In many women, this vertical chest wrinkle (or group of wrinkles) can develop to be quite deep and distinct.

Prior art techniques for eliminating wrinkles have numerous drawbacks. Chemicals can be applied topically to the skin to tend to shrink the skin somewhat and eliminate wrinkles. The large cleavage area and the relatively deep vertical chest wrinkles which form in this area do not lend themselves to elimination through the application of such topical products. Also, such products often make the skin uncomfortably sensitive. Chemicals can be injected to eliminate wrinkles (e.g. BOTOX, a trademark of Allergan, Inc. of Irvine, Calif.). Such injections actually kill nerve endings and are generally more effective where wrinkles are formed due to muscle tension and relaxation actions, such as associated with the face, rather than in large low muscle density skin areas such as the cleavage area of the chest. Another prior art wrinkle treatment option is to undergo plastic surgery to tighten the skin by making appropriate incisions and stretching the skin to alleviate the wrinkles. Such surgery carries with it the associated risks of major surgery and the difficulty of hiding incision lines as well as the trauma associated with such surgery; not to mention the attendant significant costs.

Accordingly, a need exists for methods and apparatuses for eliminating vertical chest wrinkles with greater effectiveness and lesser related drawbacks. Such techniques and devices should effectively minimize or eliminate such vertical chest wrinkles, such as by keeping the skin from folding against itself when a woman is lying on her side.

SUMMARY OF THE INVENTION

With this invention an undergarment is provided which, when worn by a woman, keeps her breasts sufficiently spaced apart from each other to prevent skin in a cleavage area between the breasts from folding so that vertical chest wrinkles are not formed, or if they have already formed can be alleviated over time by preventing such folding in the future. The undergarment is primarily composed of a central spacer which is sized to fit between the breasts of the wearer to keep the breasts spaced apart, such as when sleeping, even when the woman is lying on her side. In particular, when lying on her side the upper breast is held above the lower breast by the central spacer so that the skin between the breasts does not fold against itself but rather remains generally planar or gently curving both between the breasts and above the breasts in the cleavage area extending up toward the neck.

This central spacer is held in place by a lower band extending around a torso of the wearer and may also optionally have an upper band extending around a torso of the wearer in one alternative embodiment. The single band or dual band style have the band(s) preferably joined together on side and rear portions of the undergarment. The breasts are thus freely positioned at both sides of the central spacer in the single cover band style. Openings are provided between the upper band and lower band in the dual band style on opposite lateral sides of the central spacer. The breasts pass therethrough so that the central spacer can remain tightly against the skin of the wearer between her breasts. The central spacer preferably has a somewhat cylindrical form and curves on a rear surface thereof which contacts the skin of the wearer in the cleavage area between the breasts. This curving rear surface thus follows a natural contour of the breasts to keep the skin in position without folds in this cleavage area.

Shoulder straps extend from an upper end of the central spacer and over shoulders of the wearer. These shoulder straps help to keep the central spacer positioned where required to press against the skin in the cleavage area and prevent skin folding and associated wrinkle formation. The shoulder straps preferably extend over the shoulders of the wearer and down to the lower band on a rear side thereof. Alternatively, the shoulder straps could be joined together behind the neck of the wearer as a single strap.

An optional central pad is also provided adjacent the central spacer and above the central spacer. This central pad is preferably formed of a foam material which can be compressed somewhat, and when compressed tends to maintain a specific shape. The foam pad preferably extends upwardly and laterally from an upper end of the central spacer and presses directly against the skin in the cleavage area between and above the breasts of the wearer. The central pad thus acts directly on the skin in the cleavage area to press the skin flat and cause any wrinkles already existing in the cleavage area to subside, and prevent wrinkle formation in the cleavage area.

In variations of this invention, the central spacer and foam pad can be formed together from similar material (foam or fabric) or from different materials. The central spacer and pad can be removably attached to the undergarment together or separately, such as for washing separately or for customizing the configuration of the undergarment. Such removability also facilitates size customization. Also, the undergarment can be incorporated into a sleep wear top in a variety of different ways to modify the appearance of the product.

OBJECTS OF THE INVENTION

Accordingly, a primary object of the present invention is to prevent the formation of vertical chest wrinkles in a cleavage area between the breasts.

Another object of the present invention is to erase vertical chest wrinkles in the cleavage area between the breasts.

Another object of the present invention is to provide an undergarment which can be worn by women to prevent the formation of vertical chest wrinkles associated with the woman sleeping on her side.

Another object of the present invention is to provide an undergarment for treatment of vertical chest wrinkles to erase vertical chest wrinkles from the cleavage area of the woman wearing the undergarment.

Another object of the present invention is to provide a method for treatment of vertical chest wrinkles to both prevent vertical chest wrinkles from forming and remove vertical chest wrinkles after they have formed.

Another object of the present invention is to provide an undergarment which can be comfortably worn while sleeping and remedy chest wrinkles in a cleavage area.

Another object of the present invention is to provide a woman's undergarment which can be easily adjusted between a looser configuration before the woman is lying down to a tighter position when a woman is lying on her side and beginning to sleep.

Another object of the present invention is to provide an undergarment which can fit comfortably on women having a wide range of bras sizes.

Another object of the present invention is to provide an item of sleep wear clothing which is both comfortable to wear and remedies chest wrinkles while the wearer sleeps.

Another object of the present invention is to provide an undergarment which allows a woman with encapsulated breast implants to sleep on her stomach and experience less discomfort.

Other further objects of the present invention will become apparent from a careful reading of the included drawing figures, the claims and detailed description of the invention.

DESCRIPTION OF THE PREFERRED EMBODIMENT

Figure 2A:
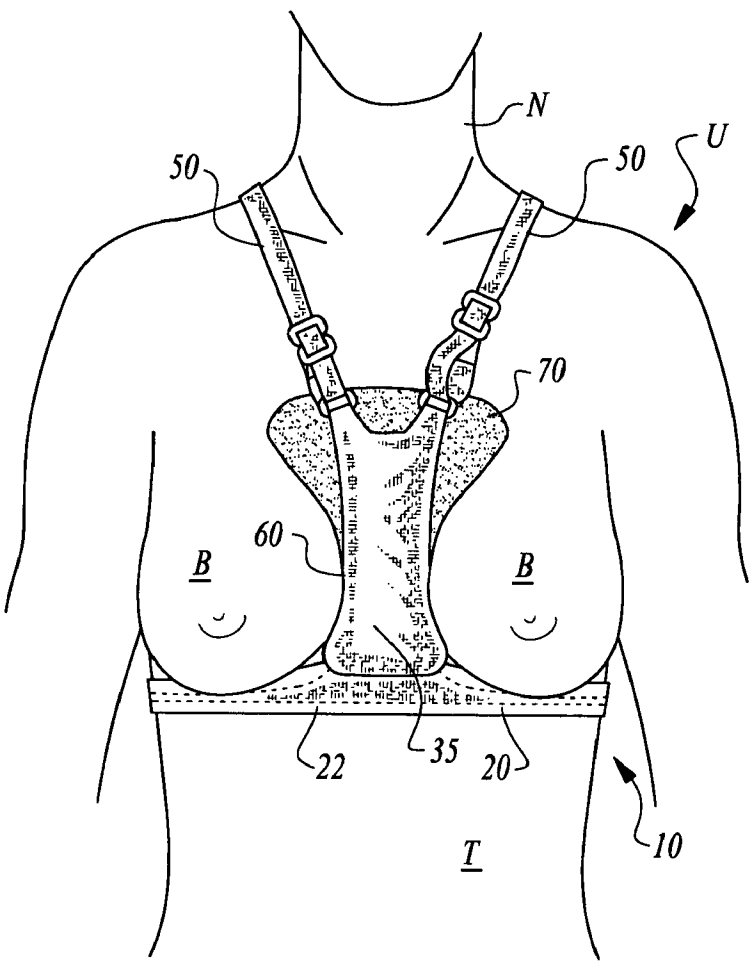
FIGS. 1A and 2A are front elevation views of the undergarment of this invention shown being worn by a woman, according to a preferred embodiment of this invention with a central spacer and a central pad, and showing wide and narrow lower band options in FIGS. 1A and 2A, respectively.
Figure 1A:
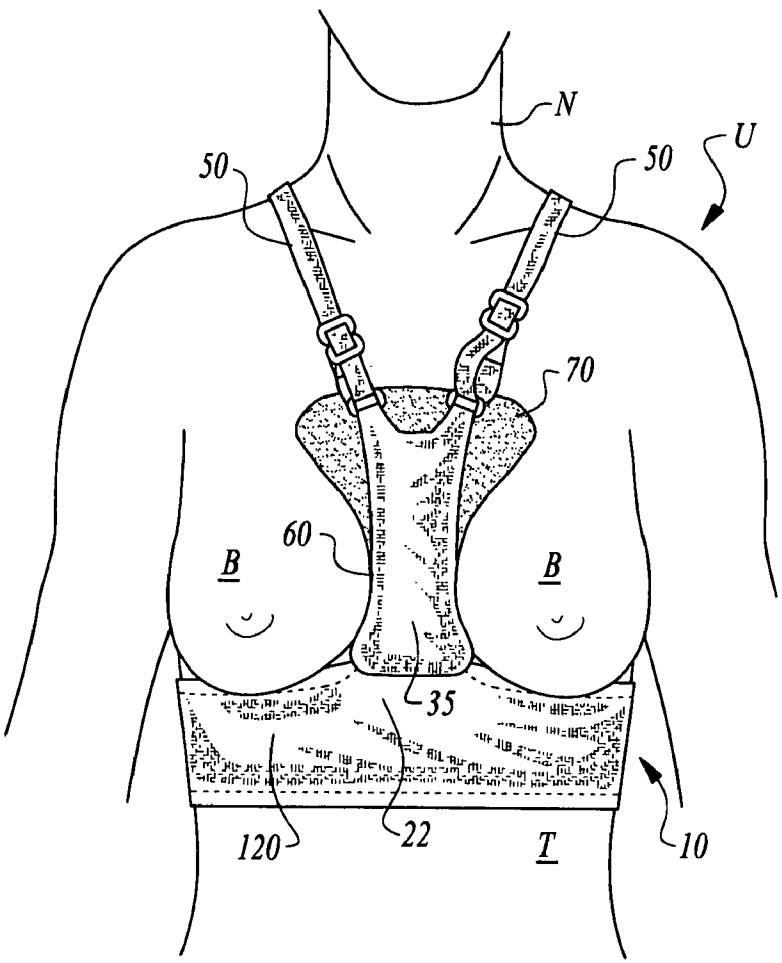
Figure 1B:
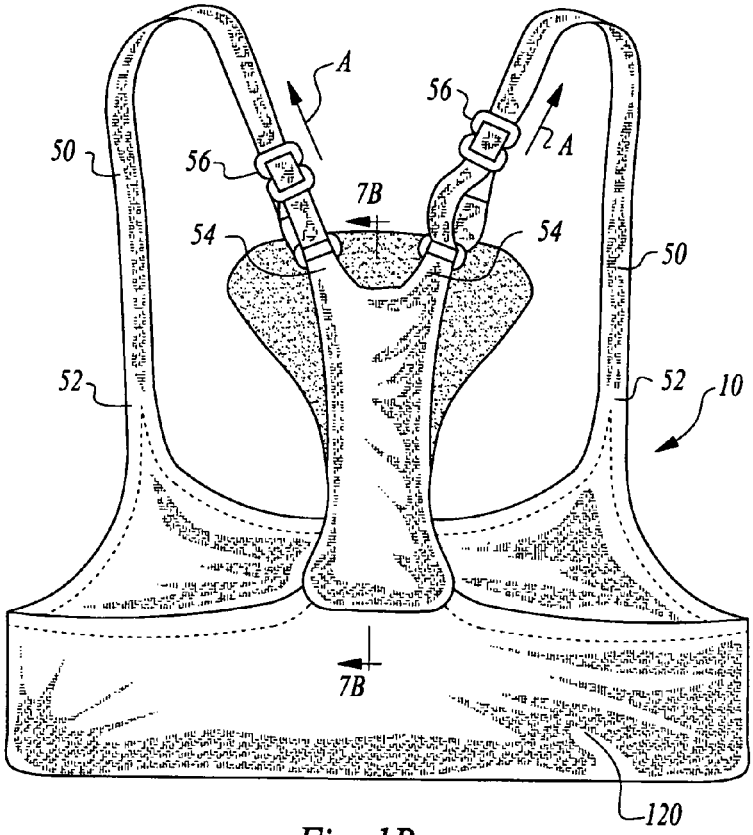
FIG. 1B is a front elevation view of that which is shown in FIG. 1A, but shown alone, rather than being worn.
Figure 2B:
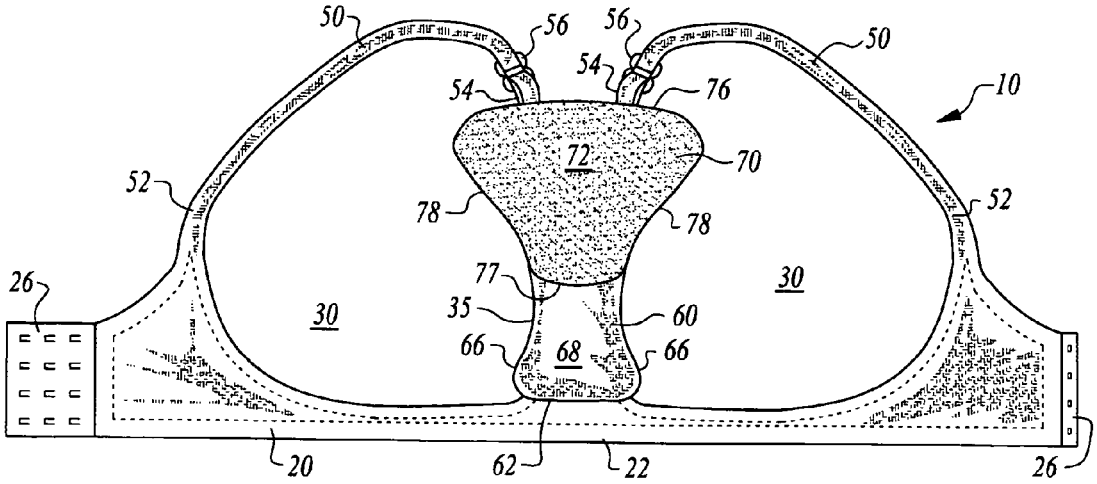
FIG. 2B is a rear elevation view of that which is shown in FIG. 2A in an open configuration as it would appear if opened and laying flat.
Figure 4A:
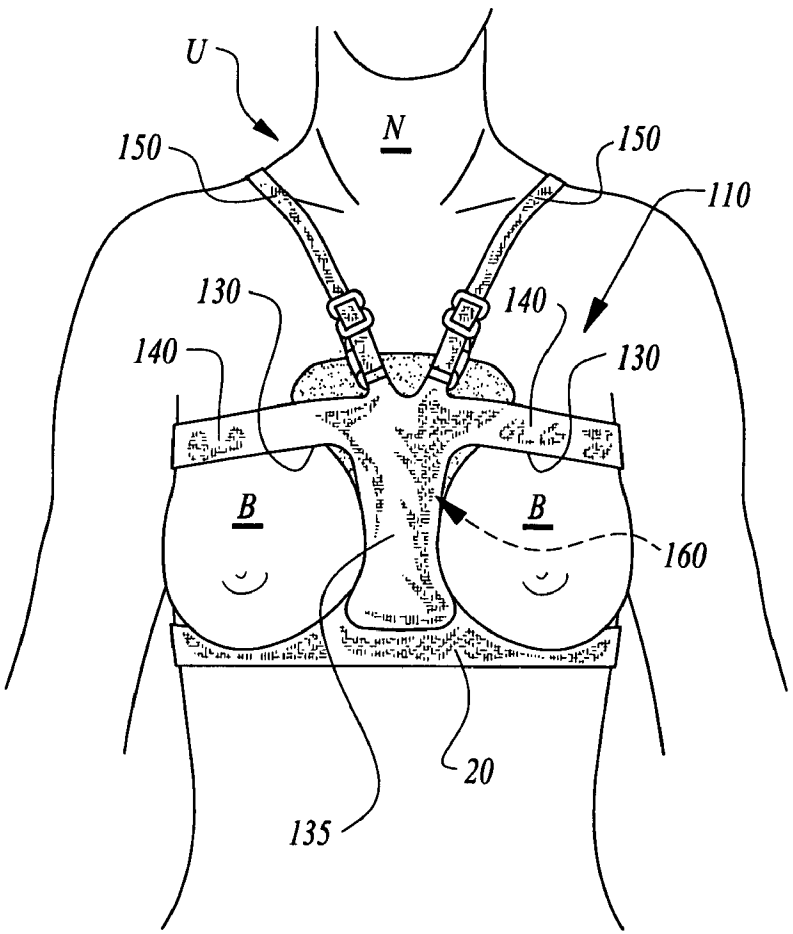
FIGS. 3A and 4A are front elevation views similar to that which is shown in FIGS. 1A and 2A, but with an embodiment thereof which includes upper bands as well as the lower bands, and showing wide and narrow lower band options in FIGS. 3A and 4A.
Figure 3A:
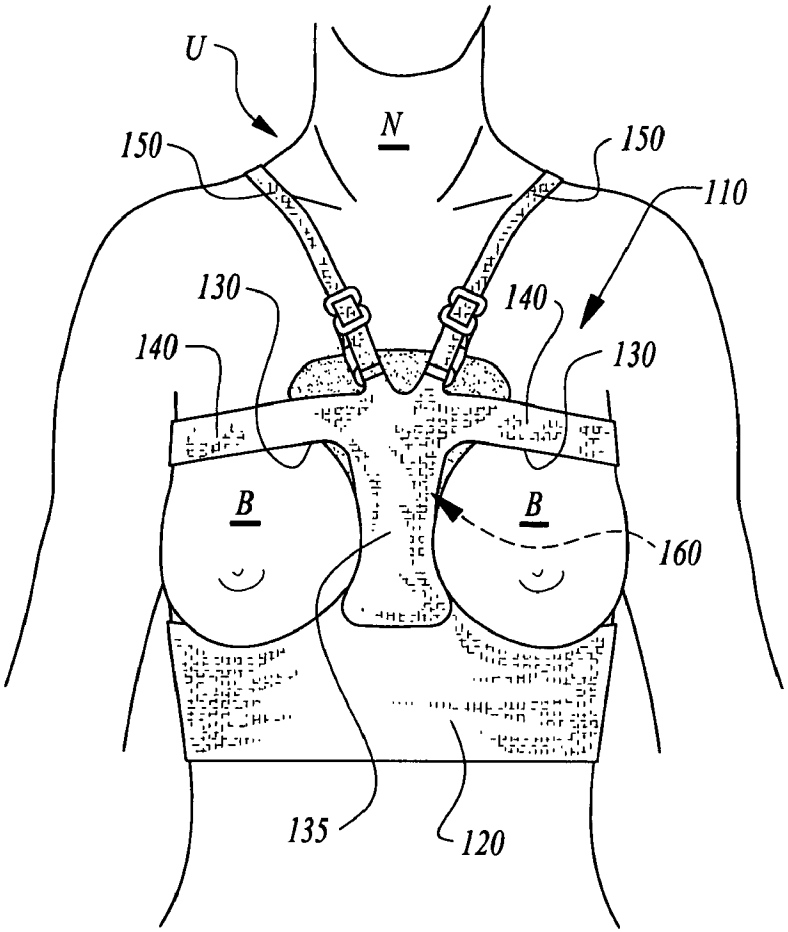
Figure 4B:
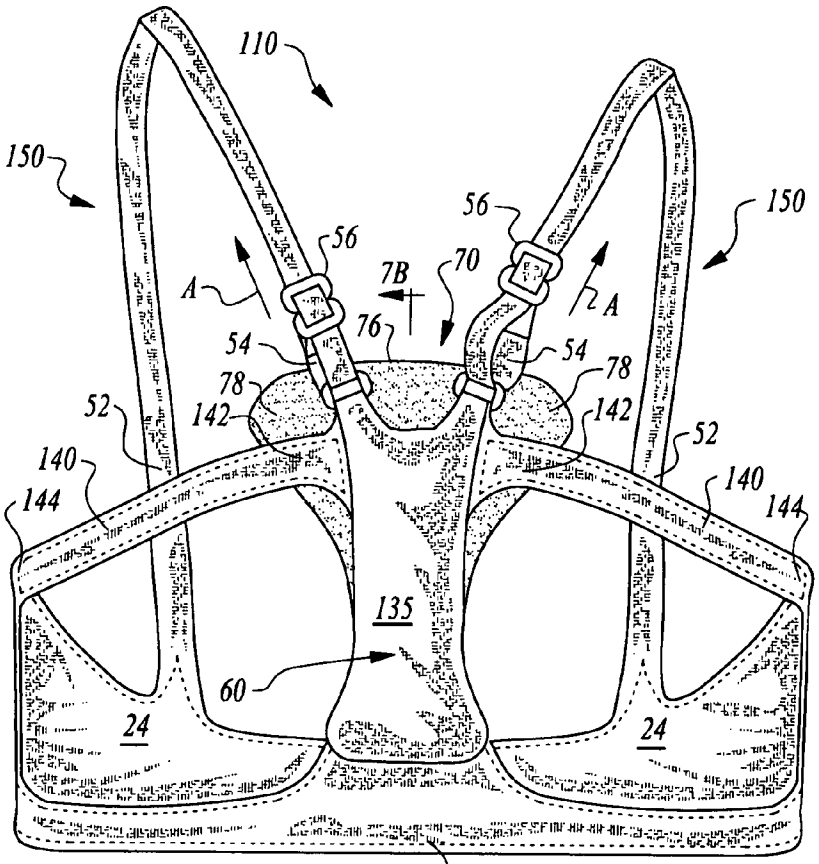
FIGS. 3B and 4B are front elevation views of that which is shown in FIGS. 3A and 4A, but with the undergarment shown not being worn.
Figure 3B:
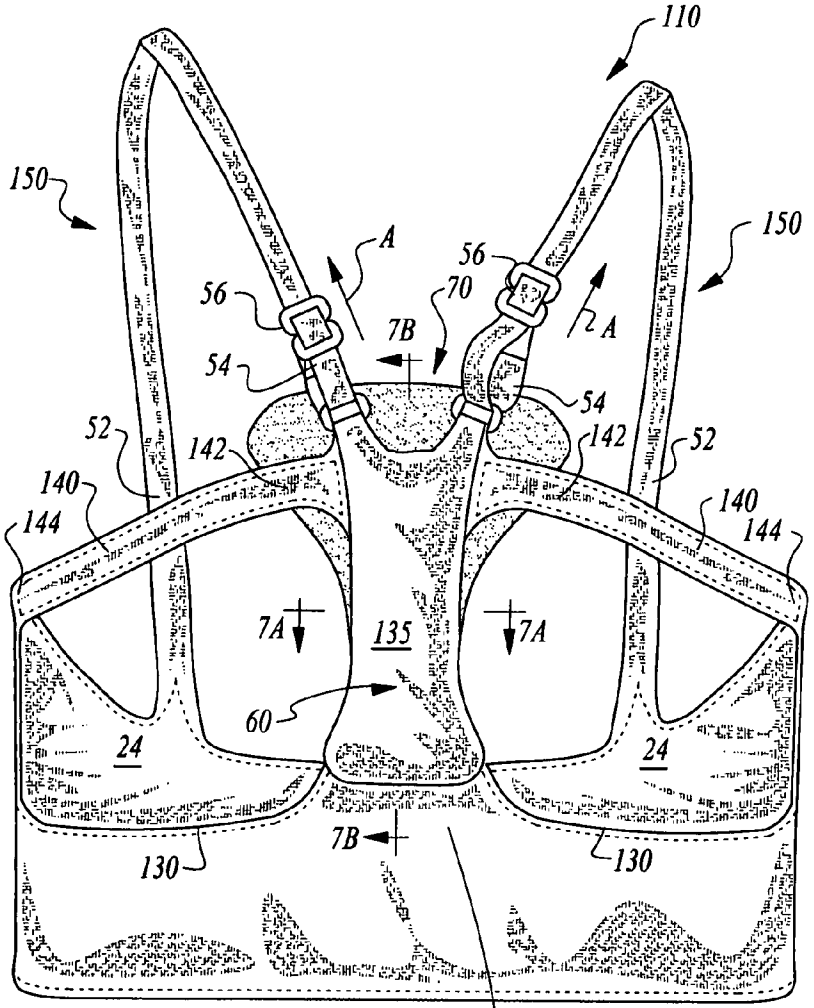

Referring to the drawings, wherein like reference numerals represent like parts throughout the various drawing figures, reference numeral 10 is directed to an undergarment (FIGS.

1A-5B, 10 and 11) which can be worn by a woman U to prevent or treat vertical chest wrinkles W (FIGS. 9 and 12) by keeping the skin in a cleavage area C from folding, especially when the woman U is lying on her side, such as during sleep. Vertical chest wrinkles W often form in the cleavage area C when a woman U is lying on her side. In particular, the lower breast B of the woman is supported by the mattress M (FIGS. 9-11) or other underlying support and so it does not move the lower breast B significantly. The upper breast B is drawn by gravity into contact with the lower breast B. With the breasts B thus brought into contact with each other, a fold in the skin extends vertically towards the neck N and over time often develops into a vertical chest wrinkle W or a series of wrinkles W (FIG. 12) in the cleavage area C.

In essence, and with particular reference to FIGS. 1A-2B, 10 and 11, basic details of the undergarment 10 of this invention are described according to a preferred embodiment. The undergarment 10 is formed of various different sections of flexible fabric or other flexible material joined together by stitching or provided as a single or small set of separate sections. These sections include a lower band 20 which is sized to extend laterally around a torso of the wearer U. Openings 30 are located above the lower band 20 and on both sides of a central panel 35. The openings 30 are sized sufficiently to allow the breasts B of the woman to pass through the openings 30. The central panel 35 of the undergarment 10 extends generally vertically up from the lower band 20 and remains in contact with the skin of the wearer U between the breasts B and extending up to a portion of the cleavage area C of the woman U.

Shoulder straps 50 extend over the shoulders of the wearer U and preferably attach to the lower band 20 on a rear side of the undergarment 10. These shoulder straps 50 are preferably adjustable in length, such as through movement of an adjustment slide 56 (along arrow A of FIGS. 1B, 10 and 11). A central spacer 60 is located adjacent the central panel 35. This central spacer 60 preferably has a generally cylindrical form and acts to keep the breasts B spaced from each other and to prevent folding of skin between the breasts B and between and above the breasts B in the cleavage area C. A central pad 70 is optionally also included (FIGS. 1A-4B). This central pad 70 can press directly against vertical chest wrinkles W in the cleavage area C between and above the breasts B to press the skin flat and over time reduce or eliminate vertical chest wrinkles W in this cleavage area C.

More specifically, and with particular reference to FIGS. 1A-2B, details of the lower band 20 and related wide lower band 120 of the undergarment 10 are described. The lower band 20, 120 acts as a preferred form of a means to keep the central spacer 60 pressing against the wearer U between the breasts B to prevent skin folding and associated wrinkle W formation. The lower band 20 has a length sufficient to pass entirely around a torso of the wearer U. Most preferably, this lower band 20 has a midpoint 22 at which it is coupled to the central spacer 60.

The wide or narrow lower band 20, 120 extends in each direction away from the midpoint 22 to rear panels 24. These rear panels 24 each include complemental clasps 26 thereon to allow for removable attachment of the rear panels 24 together. When the rear panels 24 are opened, the undergarment 10 can be conveniently donned by the wearer U. Once the clasps 26 have been closed, the undergarment 10 remains in place upon the wearer U. The clasps 26 can be any of a variety of different configurations or styles, with generally the variety of clasps known for use in the attachment of bras and other similar undergarments being utilizable, in place of the clasps 26 shown in the preferred embodiment, shown by way of example.

The lower band 20, 120 is preferably highly elastic like a lower band of a standard bra. Such high elasticity helps to allow a woman to freely breathe and maximize the comfort of the undergarment 10. The elasticity also helps to hold the lower band 20 in place directly below the breasts B when the undergarment 10 is worn by the wearer U.

With reference to FIGS. 3A-4B, details of upper bands 140 are described according to an alternative embodiment dual band embodiment 110. The upper bands 140 extend laterally away from the central spacer 60. These upper bands 140 include center ends 142 where they attach to the central spacer 60 and side ends 144 which extend to sides of the undergarment 110, where the upper bands 140 preferably are joined to the lower band 20, 120. In particular, these side ends 144 preferably terminate with connection to the rear panels 24 of the lower band 20, 120.

The upper bands 140 act along with the lower band 20, 120 to keep the central spacer 60 aligned vertically and against the skin of the wearer U between the breasts B.

With reference to FIGS. 2B-4B, details of openings 30, 130 for the undergarment 10, 110 are described. Openings 30 are provided on lateral sides of the central spacer 60. The central spacer 60 is sometimes supported on a central panel 35 which acts as a section of fabric extending up from the midpoint 22 of the lower band 20, 120. While the central panel 35 is spaced away from the skin of the wearer U, the central spacer 60 is in direct contact with the skin of the wearer U between the breasts B. The central panel 35 and central spacer 60 can fully (or at least partially) integrated into a common structure extending up from the midpoint 22 of the lower band 20, 120. As an option, the central panel 35 can be omitted and adjacent portions of the undergarment can be coupled directly to the spacer 60, such as at upper and lower portions of the central spacer 60.

While the openings 30 are not strictly required and could be covered by a fabric cup of some kind (or some other covering), most preferably the openings 30 are entirely open. With such complete opening of this area defined by the openings 30, the central spacer 60 can be readily brought into direct and firm contact against the skin of the wearer U between the breasts B.

The undergarment 10 can be configured to provide both modesty and potentially a more desirable appearance, such as by attaching loose fabric which can drape downward over the openings 30. Alternatively, the entire undergarment 10 could be coupled to a top which could hide some or all of the different sections of the undergarment 10 and simultaneously provide for enhanced modesty. As another alternative, the wearer U could merely wear a shirt or other sleep wear top over the top of the undergarment 10 to provide for modesty and to conceal the undergarment 10. It is also conceivable that a cup of fabric could be provided over each of the openings 30 with the benefit of the undergarment 10 of this invention being maintained.

With continuing reference to FIGS. 1A-4B, details of the shoulder straps 50, 150 are described. The shoulder straps 50, 150 are provided in a preferred embodiment of this invention to further assist in keeping the central spacer 60 precisely aligned between the breasts B and firmly against the skin of the wearer U. The shoulder straps 50, 150 are provided as a pair which each extend from a rear end 52 to a front end 54. The rear end 52 is preferably coupled to the rear panels 24 of the lower band 20 on a rear side of the undergarment 10. The front ends 54 preferably are joined to the central panel 35 on an upper portion thereof.

Adjustment slides 56 are preferably formed on the shoulder straps 50. These adjustment slides 56 can be moved upward toward the shoulders of the wearer U (FIGS. 10 and 11) to shorten the shoulder straps 50. The undergarment 10 is most comfortable when the woman U wearing the undergarment 10 is lying on her side with the shoulder straps 50 somewhat loose. For proper performance of the undergarment 10 with the central spacer 60 firmly pressed between the breasts B, the shoulder straps 50 are preferably tightened. Hence, the user would typically move the adjustment slides 56 upward (along arrow A of FIGS. 10 and 11) to shorten the shoulder straps 50 when the wearer U retires to bed and is lying down. If adjusted in a standing position, upon lying down, slack in the straps would be apparent, diminishing the effectiveness of the product.

These shoulder straps 50 are preferably formed of a fabric material which is not elastic and so maintains constant length. Thus, the only adjustability in the shoulder straps 50 is provided through movement of the adjustment slide 56. While a particular adjustment slide 56 type mechanism is shown for length adjustment of the shoulder straps 50, other forms of shoulder strap 50 length adjustment could be utilized other than the adjustment slide 56. For instance, the shoulder straps 50 could have a buckle arrangement for length adjustment. The shoulder straps 50 could use velcro fasteners for length adjustment. The shoulder straps 50 could be in the form of free ends which can be tied at various different positions to adjust their length. Other length adjustability including selection of different hook and eyelet combinations might also be utilized for such length adjustability.

The adjustment slides 56 or other length adjustment for the shoulder straps 50 are preferably located on a front side of the shoulder straps 50. In such a position, the wearer U can readily make the adjustment required to reconfigure the undergarment 10 from the loose configuration to a tight configuration for when the wearer U is ready to retire. To assist in grasping and lifting the adjustment slides 56 vertically, tabs can be added to the adjustment slides 56, so that they can be readily grasped and lifted.

With particular reference to FIGS. 1-7, details of the central spacer 60 are described according to a preferred embodiment. The central spacer 60 is preferably a generally cylindrical elongate object extending from a lower end 62 to an upper end 64. Lateral sides 66 of the central spacer 60 are preferably closer to each other than a length of the central spacer 60 between the lower end 62 and upper ends 64. A core 65 of the central spacer 60 is preferably formed of layers of material similar to that forming the outer surface of the central spacer 60. For instance, in a preferred form of this invention a series of layers of thick soft cotton fabric material is utilized. Such material provides a firm support for the breasts B while being a breathable material which is not uncomfortable for most women U to have against their skin, and is readily washable. Different surface materials could be provided to suit the comfort desires of the wearer U. Beneficially, the surface material is not too slippery so that the central spacer 60 tends to remain in position where desired between the breasts B and against the skin of the wearer U.

Figure 6A:
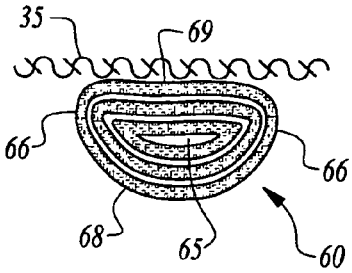
FIG. 6A is a sectional view of a portion of the central spacer of this invention, taken along lines 6A-6A of FIG. 6B.
Figure 6B:
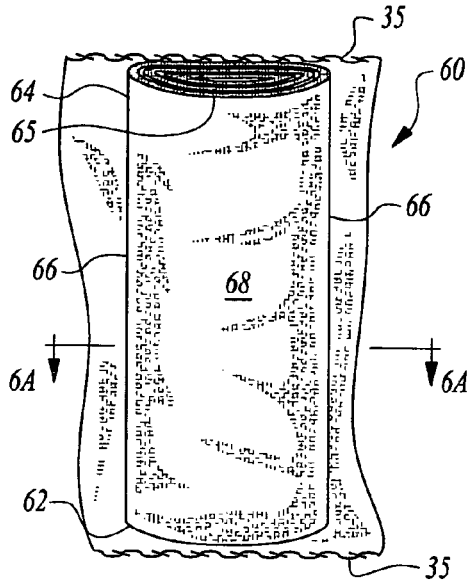
FIG. 6B is a rear perspective view of the central spacer of this invention.

The central spacer 60 is preferably slightly greater in diameter adjacent the lower end 62 and adjacent the upper end 64. Thus, the central spacer 60 has a slightly hourglass shape. Also, the central spacer 60 is preferably flattened somewhat so that it is not entirely circular in cross-section (FIGS. 6A and 6B). With such a configuration, a generally flat outer side 69 thereof is located adjacent the central panel 35 or away from the skin while a more curving rear surface 68 presses against the skin of the wearer U between the breasts B. Such a gently curving contour generally matches a natural contour of the skin between the breasts B so that any propensity for skin folding is resisted by this central spacer 60 contour on this rear surface 68 thereof.

The outside surface 69 of the central spacer 60 is opposite the rear surface 68 and is typically stitched directly to the central panel 35 or formed integrally with the central panel 35. As an alternative, the outside surface 69 could be made removably attachable to the central panel 35. If no central panel 35 is provided, the outside surface 69 or other portions of the central spacer 60 could be coupled to the straps 50, 150 near an upper end thereof and coupled to the lower band 20, 120 of the undergarment 10. Such removable attachability facilitates removal of the central spacer 60 for separate washing thereof, or for sizing of the undergarment 10, such as with different central spacers 60 provided to suit the comfort desires of the wearer U or to accommodate different breast B sizes and/or sternum anatomy for the wearer U or to otherwise adjust the performance of the undergarment 10. Such adjustability of the central spacer 60 could also be in the form of the central spacer 60 having different lengths or different shapes. For instance, as discussed in detail below, the spacer can have a wider form on an upper portion thereof as depicted by the T-pad 160 of FIGS. 5A and 5B.

With particular reference to FIGS. 1A-4B, 7A and 7B, details of the central pad 70 are described according to a preferred embodiment. A central pad 70 is not strictly required. The central pad 70 is beneficially provided where the wearer U already has wrinkles W or where it is apparent that without the central spacer 60 some degree of folding of the skin still occurs in the cleavage area C. The central pad 70 presses against the skin in the cleavage area C to press the skin flat and resist wrinkle W formation or minimize existing wrinkles in this cleavage area C. The central pad 70 is preferably formed of a foam material which can be compressed up to fifty percent or more relatively easily and tends to take the shape of the objects which are pressing against the foam. With such a character, the central pad 70 is configured so that it is pressed against the skin of the wearer U in the cleavage area C. As the central pad 70 presses against the skin in this area, the skin is prevented from folding and so wrinkles W are prevented from forming.

Figure 7B:
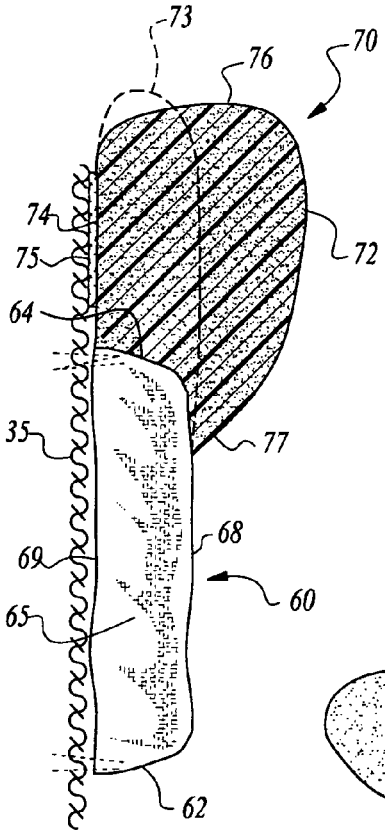
FIG. 7B is a full sectional side elevation view of the central spacer and pad which is shown in FIGS. 1B, 3B and 4B, taken along lines 7B-7B of FIGS. 1B, 3B and 4B.
Figure 7A:
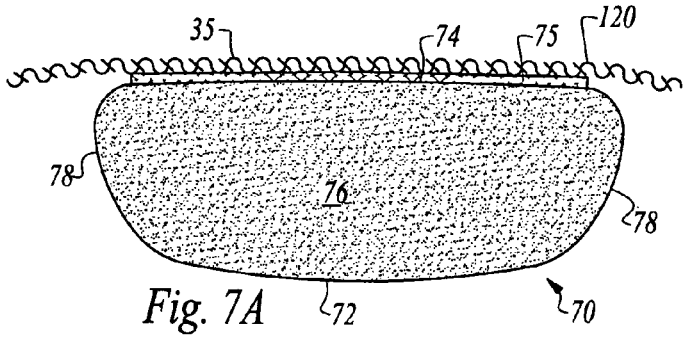
FIG. 7A is a full sectional view of the central pad of this invention, taken along lines 7A-7A of FIG. 3B.
Figure 8A:
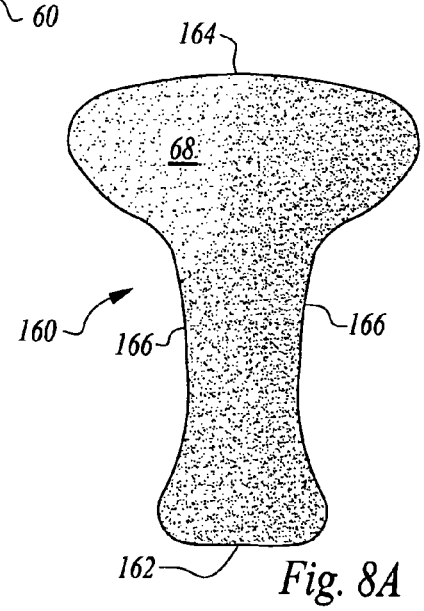
FIGS. 8A and 8B are front and side full sectional views of a central pad portion of that which is shown in FIGS. 1A-4B.
Figure 8B:
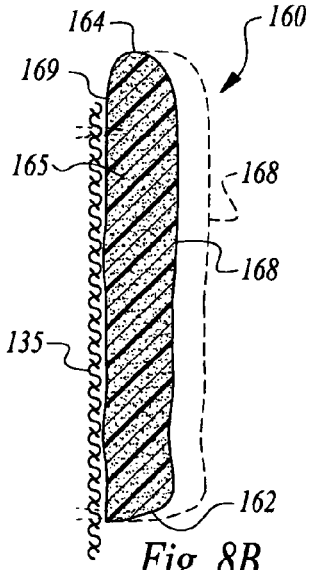

The central pad 70 has a somewhat irregular shape (shown best in FIGS. 7A and 7B). This irregular shape includes a contact surface 72 which is on a side adapted to come into contact with the skin of the wearer U over the cleavage area C. This contact surface 72 can be flat or slightly convex. Preferably, the central pad 70 is formed of a material which relatively easily compresses to fifty percent of its original volume. Thus, this contact surface 72 adjusts into a compressed surface 73 after coming into contact with the cleavage area C of the wearer U. This compressed surface 73 will then take on a contour matching the contour of the skin of the wearer U in the cleavage area C. The compressed surface 73 thus keeps the skin of the wearer U from folding over and prevents wrinkles W from forming. If wrinkles W have already formed, the pad 70 tends to flatten out the skin adjacent the wrinkle W to cause the wrinkle W to diminish or even eliminate the wrinkle W altogether.

An attachment surface 74 is provided opposite the contact surface 72. This attachment surface 74 is provided with a fastener 75 which can be fastened to the central panel 35. For instance, this fastener 75 could be one portion of a hook and loop type fastener, such as a Velcro fastener, with the other portions of the complemental fastener included on the central panel 35. Other forms of fasteners 75 could also be utilized. The central pad 70 can thus be removed from the undergarment 10, such as for separate washing of the central pad 70 or other portions of the undergarment 10. Also, this allows for replacement of the central pad 70 should it become damaged or worn, and also would allow for resizing of the central pad 70 to different sizes to match the particular anatomy of the wearer U in the cleavage area C, or to match an area of wrinkles W to be treated.

The central pad 70 also includes a top 76 opposite a bottom 77 and sides 78 opposite each other which are each preferably somewhat rounded as shown in the various figures depicting the central pad 70. The central pad 70 could have a variety of different shapes other than those depicted in the drawings. In one embodiment, the central pad 70 can be formed as the T-pad 160 (FIGS. 5A and 5B) and the central spacer 60 can be eliminated, so that such a T-pad 160 provides both the role of the central spacer 60 and that of the central pad 70.

With particular reference to FIGS. 1A, 1B, 3A, 3B, 5A, 5B and 11, details of an alternative embodiment wide band 120 for the undergarment 10, 110 are described. The wide band 120 is similar to the lower band 20 described above, except where specifically described herein. This wide band 120 is preferably formed of a LYCRA (a trademark of Invista North America S.A.R.L. of Wilmington, Del.) material or could also be conceivably formed of some other material which exhibits a high degree of elasticity for enhanced comfort, such as a nylon material, spandex material or other similar materials.

The wide band 120 undergarment 10, 110 includes the wide lower band 120 which is typically two to three times wider than the lower band 20 of the undergarment 10, 110. Openings 30, 130 are provided above the wide lower band 120 and upper bands 140 are optionally provided (FIGS. 3B, 5A and 5B) above the openings 30, 130. A central panel 135 extends between the wide lower band 120 and the upper bands 140. Also in this embodiment, shoulder straps 150 extend up from the central panel 135 over shoulders of the wearer U and down to rear portions of the wide lower band 120.

The wide lower band 120 undergarment 210 (FIGS. 5A, 5B) can be used with the T-pad 160 as the spacer for keeping the breasts B spaced from each other when the woman U is lying on her side. This T-pad 160 could be utilized with the undergarment 10 of the first embodiment, or could be utilized with the wide lower band 120 of this embodiment. Also, the central spacer 60 and/or central pad 70 could be utilized with the wide lower band 120 of this embodiment.

Figure 5A:
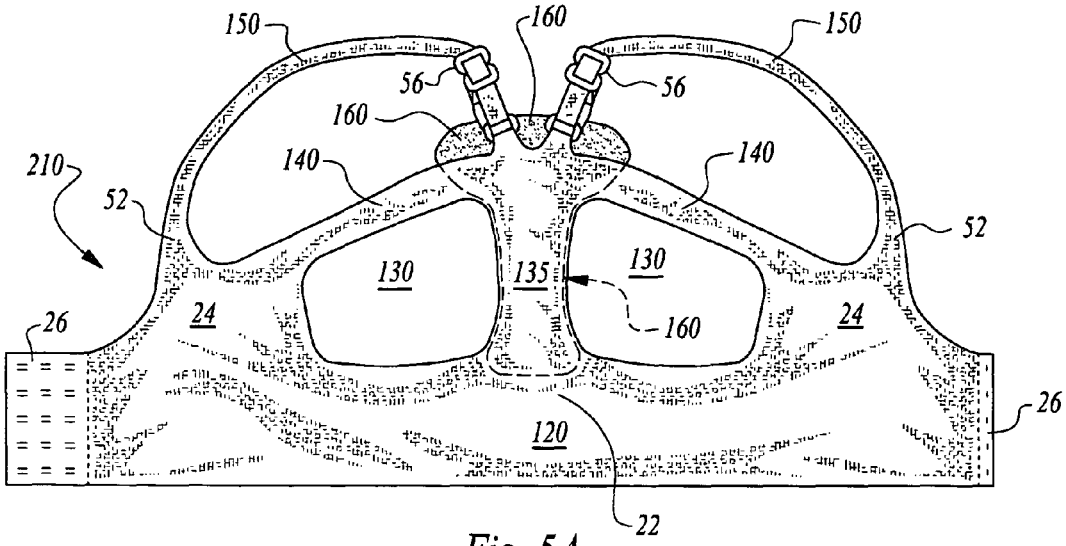
FIGS. 5A and 5B are front and rear elevation views of an alternative embodiment of that which is shown in FIGS. 3A and 3B, shown open as if laying flat and showing an alternative pad for breast spacing.
Figure 5B:
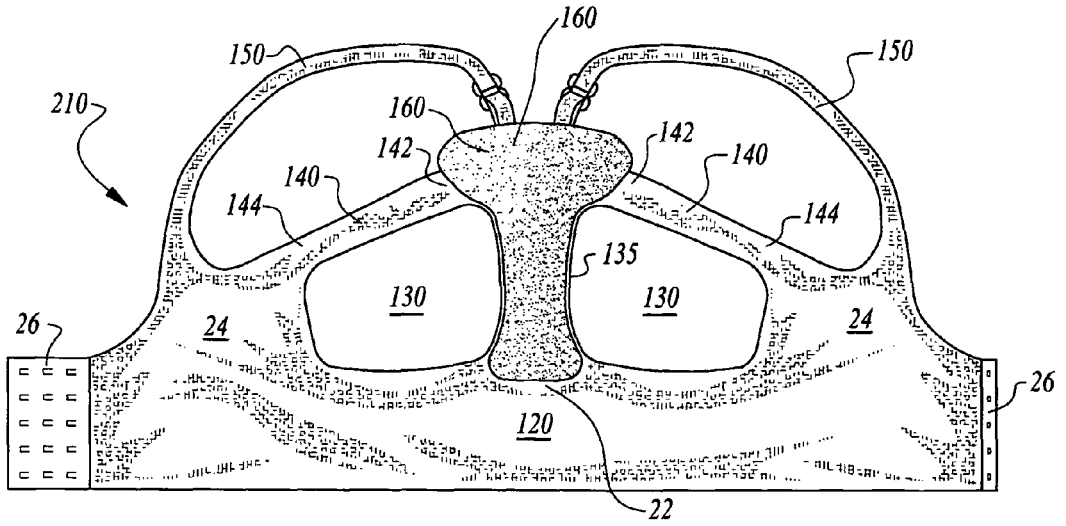

The T-pad 160 of FIGS. 5A and 5B is formed of a single material in this embodiment and has a generally cylindrical portion oriented vertically along the central panel 135 to act as a spacer between the breasts B of the wearer U and an upper portion which is wider and is generally designed to press against skin of the wearer U in the cleavage area C between and above the breasts B. Preferably, such a T-pad 160 is removably attachable to the wide band undergarment 110 or other undergarment 10 for separate washing and/or for particularly sizing the T-pad 160 for maximum effectiveness, comfort or to match particular anatomy of the wearer U.

Figure 9:
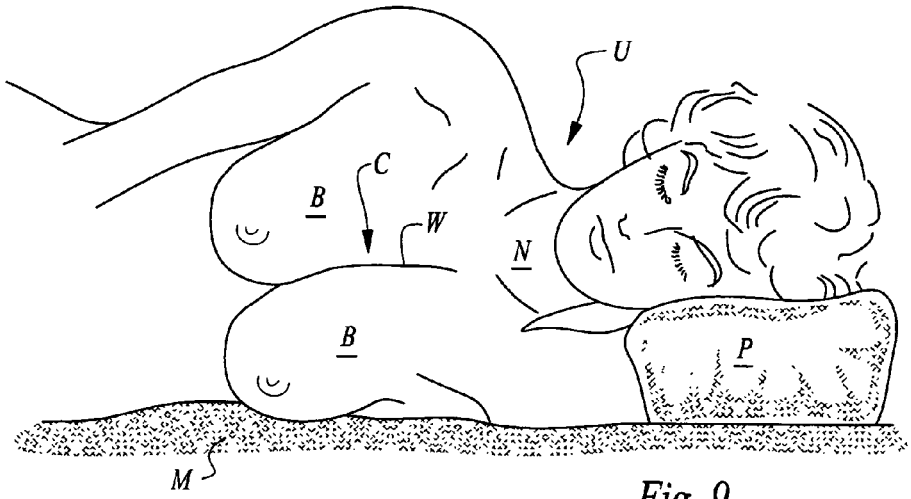
FIG. 9 is a front elevation view of a woman lying on her side and illustrating how such a resting position can lead to development of vertical chest wrinkles.
Figure 10:
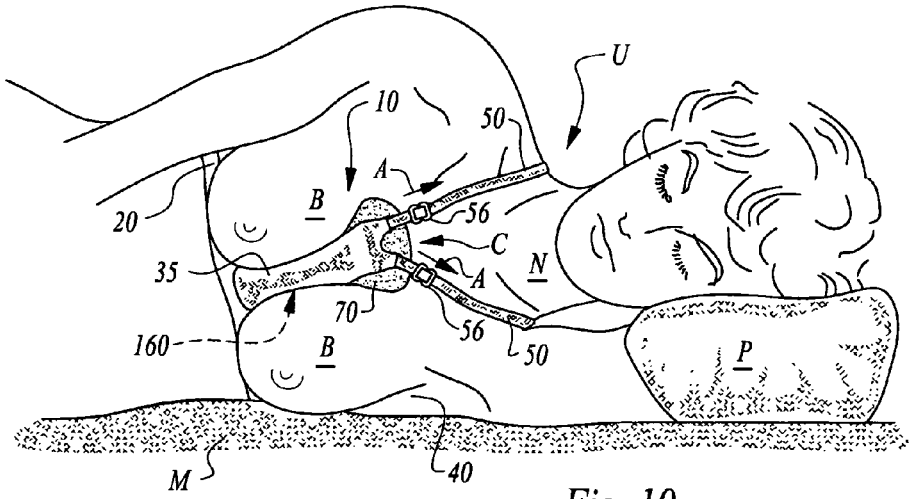
FIG. 10 is a front elevation view similar to that which is shown in FIG. 9, but with the woman wearing the undergarment of this invention according to the method of this invention to prevent and eliminate such vertical chest wrinkles, with the undergarment shown in an embodiment including both the central spacer and the central pad.
Figure 11:
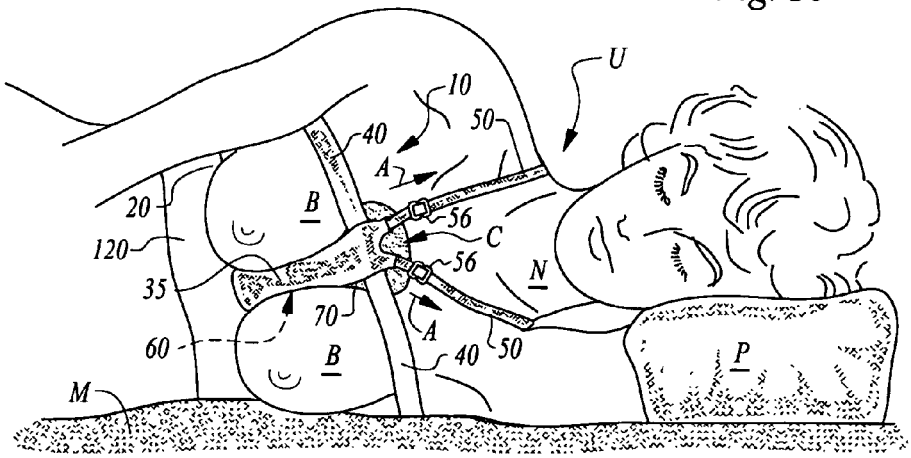
FIG. 11 is a front elevation view similar to that which is shown in FIG. 10, but in an embodiment having a wide lower band, such as is shown in FIGS. 1A and 1B.
Figure 14:
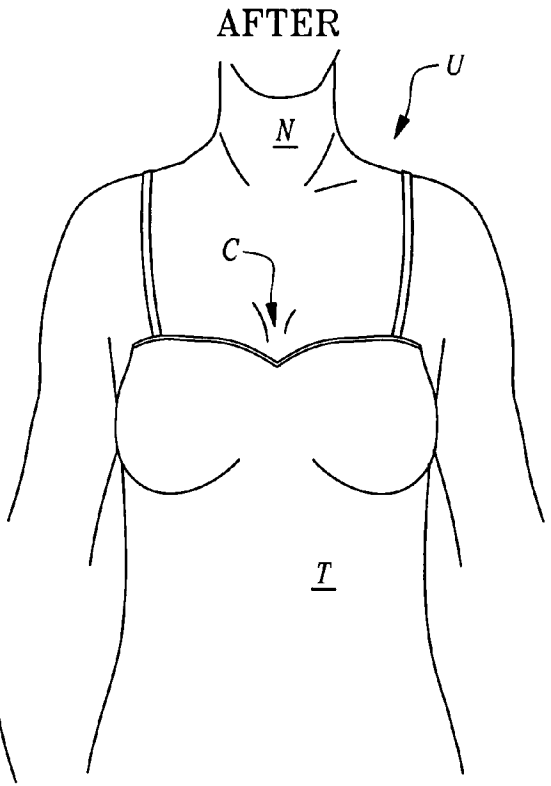
FIG. 14 is a front elevation view of the woman shown in FIG. 13 but wearing a low neckline top and illustrating how the cleavage area is still free of wrinkles and if any skin is folded against itself it is with non-vertical lines associated with the breasts coming into contact with each other or overlapping skin in the cleavage area between the breasts, rather than in the form of vertical chest wrinkles, for a most desirable final appearance.
Figure 13:
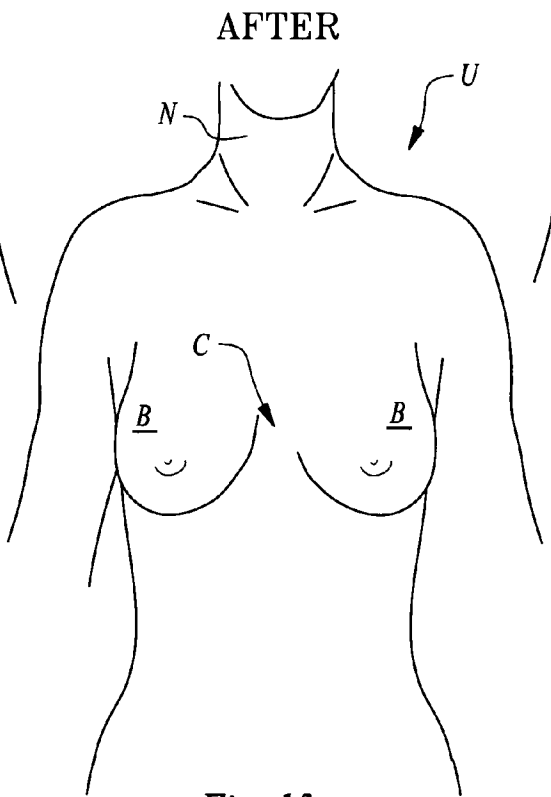
FIG. 13 is a front elevation view similar to that which is shown in FIG. 12, but after utilization of the undergarment of this invention, illustrating the cleavage area without any vertical chest wrinkles therein.
Figure 12:
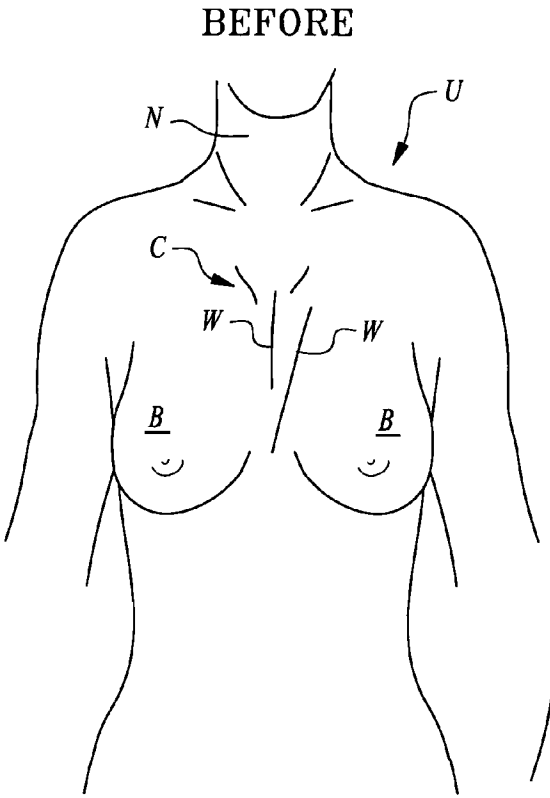
FIG. 12 is a front elevation view of a woman and revealing exemplary vertical chest wrinkles in a cleavage area between the breasts of the woman and extending toward her neck, illustrating the problem addressed by the undergarment and method of this invention.

In use and operation, and with particular reference to FIGS. 9-11, details of the use of the undergarments 10, 110, 210 of this invention are described. Initially, the undergarment 10, 110, 210 is donned by the user U, typically by placement of arms under the straps 50, 150 and attaching the clasps 26 to close the lower band 20 girding the torso of the wearer U. After such attachment, the undergarment 10, 110, 210 will have an appearance similar to that depicted in FIGS. 1A and 1B. Preferably, the shoulder straps 50, 150 are initially somewhat loose for maximum comfort when being worn while standing. When the wearer U is ready to retire to bed, the wearer U can first lie down and then adjust the shoulder straps 50, typically by shortening through movement of adjustment slides 56 or other length adjustment along arrow A (FIGS. 10 and 11). The central spacer 60 and central pad 70 (or T-pad 160) resides between the breasts B and keeps them spaced from each other and prevents skin between the breasts B and in the cleavage area C from folding against itself, so that wrinkle W formation is prevented and existing wrinkles W are diminished or entirely eliminated.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or, temporary and either in a rigid fashion or in a fashion which allows pivoting, sliding or other relative motion while still providing some form of attachment, unless specifically restricted.

What is claimed is:

1. An undergarment for treatment and prevention of chest wrinkles, the undergarment comprising in combination:

at least one band of flexible material;

said band of flexible material adapted to surround a torso of a wearer laterally;

a central spacer;

said central spacer adapted to fit between breasts of a wearer and keep the wearer's breasts further apart than if said spacer were absent;

said central spacer coupled to said at least one band;

at least one shoulder strap having a front end;

said shoulder strap coupled to said central spacer at said front end;

said shoulder strap adapted to extend over a shoulder of the wearer; and a pad separate from said central spacer and coupled to said central spacer, said pad formed of an anatomy conforming foam material and positioned to contact skin of a wearer in a cleavage area between and above the breasts of the wearer when the undergarment is worn.

2. The undergarment of claim 1 wherein said central spacer is elongate in form with a length between an upper end and a lower end greater than a width perpendicular to said length.

3. The undergarment of claim 2 wherein said shoulder strap front end is oriented adjacent said upper end of said central spacer, and wherein said at least one band of flexible material is coupled to said lower end of said central spacer.

4. The undergarment of claim 3 wherein a pair of upper bands are provided extending laterally away from said upper end of said central spacer, and a pair of openings located between said at least one band of flexible material coupled to said lower end of said central spacer and said upper bands, said openings spaced apart by said width of said central spacer, said openings each adapted to allow one of the breasts of the wearer passing therethrough.

5. The undergarment of claim 1 wherein at least two shoulder straps are provided extending from said upper end of said central spacer at a front end to a portion of said at least one band of flexible material at a rear end opposite said front end, said at least two shoulder straps each being length adjustable.

6. The undergarment of claim 1 wherein said at least one shoulder strap has two opposite ends each coupled to said central spacer, said shoulder strap adapted to be routed around a neck of the wearer at a midpoint thereof midway between ends of said strap.

7. An undergarment for treatment and prevention of chest wrinkles, the undergarment comprising in combination:

at least one band of flexible material;

said band of flexible material adapted to surround a torso of a wearer laterally;

a central spacer;

said central spacer adapted to fit between breasts of a wearer and keep the wearer's breasts further apart than if said spacer were absent;

said central spacer coupled to said at least one band;

at least one shoulder strap having a front end;

said shoulder strap coupled to said central spacer at said front end;

said shoulder strap adapted to extend over a shoulder of the wearer; and wherein a pad is provided above said central spacer, said pad formed of an anatomy conforming foam material and oriented to contact skin of the wearer in a cleavage area between and above the breasts of the wearer.

8. The undergarment of claim 7 wherein said central spacer has an elongate form extending between an upper end and a lower end, said central spacer formed of a material more firm than said pad, said central spacer having a depth between a rear surface adapted to contact skin of the wearer.

9. An undergarment for maintaining breast spacing while a wearer is sleeping on her side, to prevent and treat chest wrinkles, the undergarment comprising in combination:

a central spacer having an elongate form between an upper end and a lower end, said central spacer adapted to fit between the wearer's breasts and keep the wearer's breasts spaced from each other;

said central spacer having a substantially circular horizontal cross-section for skin contacting portions of said central spacer between said upper end and said lower end; and means to keep said central spacer against the wearer's chest and between the wearer's breasts.

10. The undergarment of claim 9 wherein openings are provided on lateral sides of said central spacer, said openings each adapted to allow one of the wearer's breasts to be located therein.

11. The undergarment of claim 9 wherein said means to keep said central spacer against the wearer's chest and between the wearer's breasts includes a lower band coupled to said lower end of said central spacer and formed of flexible material adapted to surround a torso of the wearer laterally.

12. The undergarment of claim 11 wherein a pair of straps extend from said upper end of said central spacer at a front end to a rear end coupled to said lower band.

13. The undergarment of claim 12 wherein each of said straps are adapted to be adjusted in length.

14. The undergarment of claim 12 wherein upper bands are provided extending from said upper end of said central spacer to portions of said lower band spaced from said central spacer, said upper bands extending laterally from said central spacer.

15. The undergarment of claim 9 wherein a pad of anatomy conforming foam is provided adjacent said central spacer upper end in a position adapted to contact the chest of the wearer when the undergarment is worn, said anatomy conforming foam pad adapted to press against skin of the wearer to treat wrinkles in a chest cleavage area between and above the breasts of the wearer.

16. A method for treatment and prevention of chest wrinkles, the method including the steps of:

providing a central spacer having an elongate form between an upper end and a lower end, the central spacer adapted to fit between the wearer's breasts;

providing a pad separate from the central spacer and coupled to the central spacer, the pad formed of an anatomy conforming foam material;

placing and holding the central spacer against the wearer's chest and between the breasts of the wearer; and positioning the pad to contact skin of the wearer in a cleavage area between and above the breasts of the wearer.

17. The method of claim 16 including the further steps of:

configuring the central spacer to have a curving rear surface; and bringing the central spacer into contact with the chest of the wearer between the wearer's breasts during said placing step.

18. The method of claim 17 including the further step of holding the central spacer in position between the breasts of the wearer by coupling the central spacer at the lower end to a lower band, the lower band routed around a torso of the wearer and coupling the upper end of the central spacer to at least one strap extending from the central spacer over shoulders of the wearer, the strap imparting an upward force on the central spacer.

19. The method of claim 18 including the further step of adjusting a length of the straps by tightening at least one of the straps.

20. A method for treatment and prevention of chest wrinkles, the method including the steps of:

providing a central spacer having an elongate form between an upper end and a lower end, the central spacer adapted to fit between the wearer's breasts;

placing and holding the central spacer against the wearer's chest and between the breasts of the wearer; and adding an anatomy conforming foam pad adjacent to the central spacer and above the central spacer, the foam pad oriented in position against the chest of the wearer between the breasts of the wearer, the foam pad pressing against the skin of the wearer.

* * * * *